US007591461B2

(12) United States Patent
Lien et al.

(10) Patent No.: US 7,591,461 B2
(45) Date of Patent: Sep. 22, 2009

(54) AUTOMATIC DOCUMENT FEEDER HAVING A SHEET-LIFTING MECHANISM

(75) Inventors: Szu Hui Lien, Hsinchu (TW); Thomas Sheng, Hsinchu (TW)

(73) Assignee: Avision Inc. (TW)

( * ) Notice: Subject to any disclaimer, the term of this patent is extended or adjusted under 35 U.S.C. 154(b) by 281 days.

(21) Appl. No.: 11/636,600

(22) Filed: Dec. 11, 2006

(65) Prior Publication Data

US 2007/0138736 A1 Jun. 21, 2007

(30) Foreign Application Priority Data

Dec. 16, 2005 (TW) ..... 94144662 A

(51) Int. Cl.
*B65H 1/08* (2006.01)

(52) U.S. Cl. ..... 271/126; 271/127

(58) Field of Classification Search ..... 271/126, 271/127, 161

See application file for complete search history.

(56) References Cited

U.S. PATENT DOCUMENTS 3,977,666 A * 8/1976 Suzuki et al. ..... 271/9.11
4,212,456 A * 7/1980 Ruenzi ..... 271/4.04
4,219,192 A * 8/1980 Burke ..... 271/160
5,794,928 A * 8/1998 Araseki et al. ..... 271/9.08
5,909,872 A * 6/1999 Takahashi ..... 271/116
6,039,315 A * 3/2000 Lim ..... 271/160
6,585,250 B1 * 7/2003 Hsiao ..... 271/121
6,601,845 B2 * 8/2003 Lien et al. ..... 271/209
6,648,323 B2 * 11/2003 Hsieh ..... 271/126

FOREIGN PATENT DOCUMENTS

JP 63262342 A * 10/1988
JP 01022734 A * 1/1989
JP 01181628 A * 7/1989
JP 02291325 A * 12/1990
JP 06199439 A * 7/1994

* cited by examiner

*Primary Examiner*—Patrick H Mackey
*Assistant Examiner*—Jeremy Severson

(57) ABSTRACT

An automatic document feeder includes a paper tray, a pick-up roller and a sheet-lifting mechanism. A plurality of sheets including a first sheet and a second sheet disposed above the first sheet is stored in the paper tray. The paper tray includes a bottom plate in contact with the first sheet, and a stopper for stopping leading edges of the first sheet and the second sheet. The pick-up roller, which is movable and rotatable, picks up the second sheet and enables the leading edge of the second sheet to pass over the stopper. The sheet-lifting mechanism disposed on the paper tray lifts up the leading edges of the second sheet and the first sheet from the bottom plate.

3 Claims, 8 Drawing Sheets

AUTOMATIC DOCUMENT FEEDER HAVING A SHEET-LIFTING MECHANISM

BACKGROUND OF THE INVENTION

1. Field of Invention

The invention relates to an automatic document feeder having a sheet-lifting mechanism, and more particularly to an automatic document feeder which can lift up a leading edge of a sheet elastically to facilitate a pick-up roller in picking up the sheet and a sheet feeding roller in feeding the sheet subsequently.

2. Related Art

Automatic document feeders are widely used in the apparatuses such as scanners, printers, copiers and multi-function peripherals. An automatic document feeder using a pick-up roller to pick up a sheet is commonly used in conjunction with a paper tray having a larger capacity.

Due to the mechanical design of the pick-up roller and for collocating the pick-up roller and the large paper tray, the large paper tray is usually provided with a stopper for stopping the leading edges of a stack of sheets disposed in the paper tray. So, the sheet, which is picked up by the pick-up roller, has to pass over the top of the stopper so as to reach a separating roller installed in the automatic document feeder smoothly. The stopper may be designed to have a steep or vertical surface for restricting the position of the leading edge of the sheet. In this case, when there are many sheets stacked in the paper tray, the topmost sheet of the stack is very close to the top of the stopper, and the topmost sheet can pass over the stopper without any difficulty. However, when few sheets are left in the paper tray, the topmost sheet is farther from the top of the stopper, and it is difficult for the sheet to pass over the stopper, thereby causing some disruption in the sheet feeding process.

In order to solve this problem, the stopper may be designed to have a slightly inclined surface such that the slope of the stopper is smaller. In this case, the user may unintentionally insert the sheets into the clearance between the separating roller and the sheet separating pad, and the sheet-separating function may be disabled. In addition, when there are few sheets in the paper tray, the topmost sheet still can pass over the top of the stopper easily because the slope of the stopper is gradual, despite that the topmost sheet is farther from the top of the stopper. When many sheets are disposed in the paper tray, some upper sheets are very near the top of the stopper. So, multiple sheets may easily pass over the stopper such that the stopper cannot function to stop the sheet and the sheet cannot be easily fed. In addition, the gradually sloped stopper occupies larger space because it has the inclined surface with the smaller slope. Thus, the prior art cannot solve the problems presented when the sheets in the paper tray are many or few.

SUMMARY OF THE INVENTION

It is therefore an object of the invention to provide an automatic document feeder having a sheet-lifting mechanism for partially lifting a sheet to help the sheet pass over a stopper of a paper tray such that the sheet may be fed smoothly.

To achieve the above-identified object, the invention provides an automatic document feeder including a paper tray, a pick-up roller and a sheet-lifting mechanism. The paper tray stores a plurality of sheets including a bottommost first sheet and a second sheet above the first sheet. The paper tray includes a bottom plate in contact with the first sheet and a stopper for stopping leading edges of the first sheet and the second sheet. The pick-up roller, which is movable and rotatable, picks up the second sheet and enables the leading edge of the second sheet to pass over the stopper. The sheet-lifting mechanism disposed on the paper tray lifts the leading edges of the second sheet and the first sheet from the bottom plate.

Further scope of the applicability of the present invention will become apparent from the detailed description given hereinafter. However, it should be understood that the detailed description and specific examples, while the indicating preferred embodiment of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
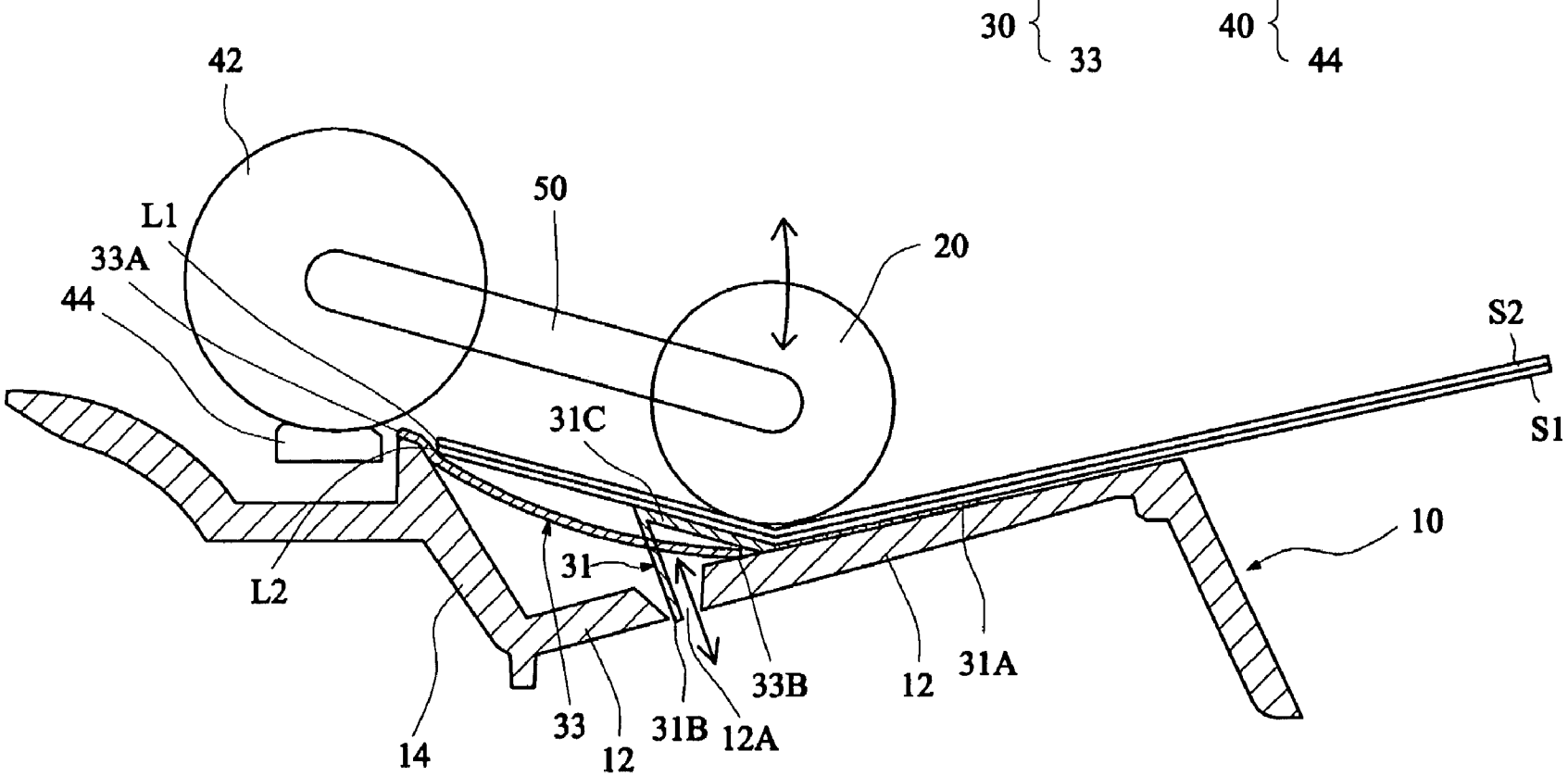
FIG. 1 is a schematic illustration showing an automatic document feeder having a sheet-lifting mechanism according to a preferred embodiment of the invention.
Figure 2:
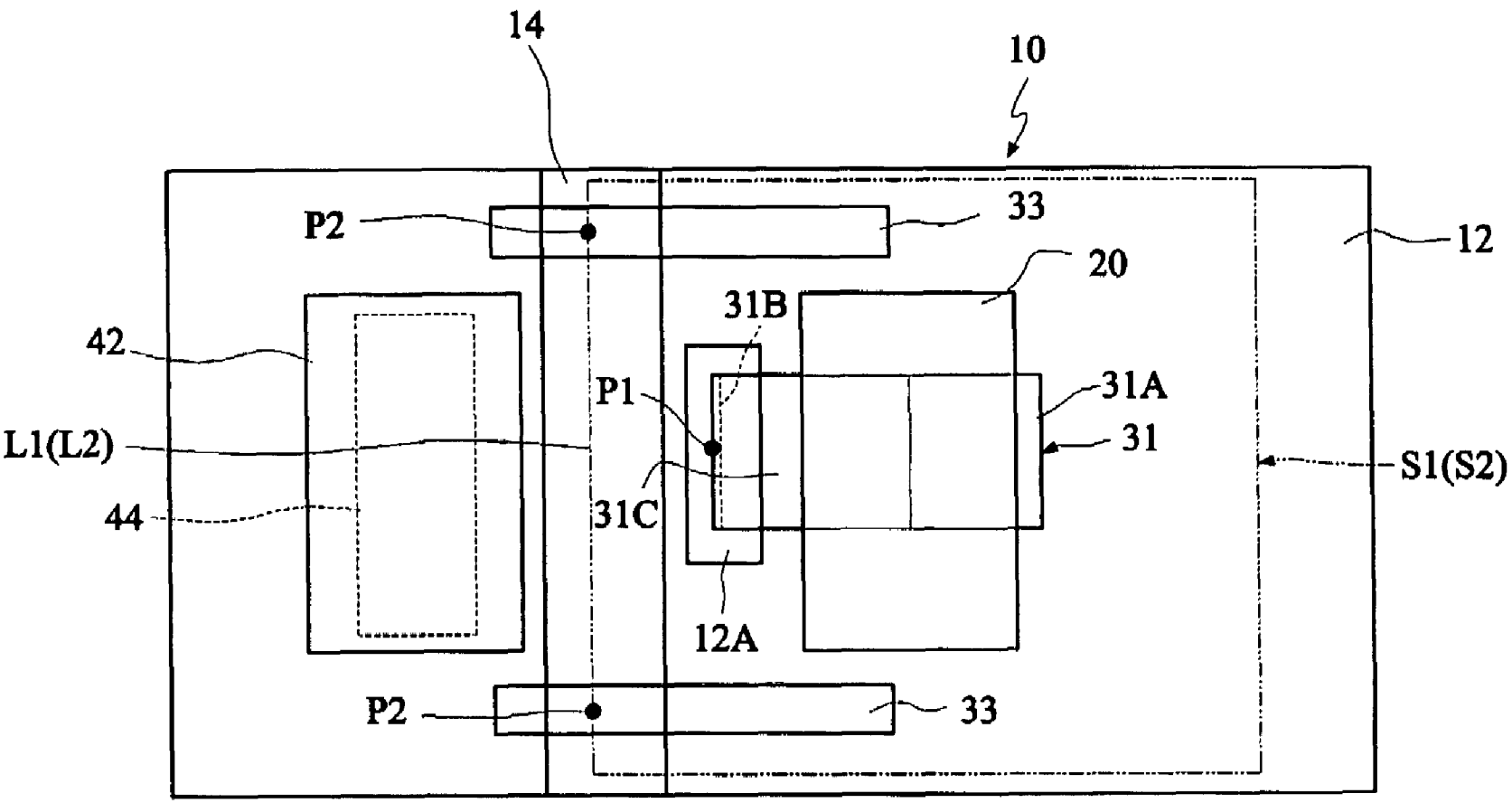
FIG. 2 is a top view of FIG. 1.

FIG. 1 is a schematic illustration showing an automatic document feeder having a sheet-lifting mechanism according to a preferred embodiment of the invention. FIG. 2 is a top view of FIG. 1. Referring to FIGS. 1 and 2, the automatic document feeder according to this embodiment includes a paper tray 10, a pick-up roller 20, a sheet-lifting mechanism 30, a sheet separating mechanism 40 and a rocker arm 50.

The paper tray 10 stores a plurality of sheets including, for example, a bottommost first sheet S1 and a second sheet S2 above the first sheet S1. Although two sheets are described, one of ordinary skill in the art may easily understand that the invention is also suitable for the application of more than two sheets or a single sheet. However, the conditions of feeding two sheets and one sheet occur at the end of the overall feeding processes no matter how many pages of sheets are originally placed in the paper tray. The main function of the invention is to solve the problem in the prior art, which occurs when there are few sheets, such as two or one. The sheet-lifting mechanism of the invention mainly functions to lift the sheets when there are few sheets. When many sheets are stacked, the sheets cannot be lifted because the sheet-lifting force provided by the sheet-lifting mechanism cannot overcome the weight of all the sheets. In fact, when there are many sheets in the paper tray, the topmost sheet is very near the top of a stopper. Thus, the sheet feeding operation cannot be interrupted even if the sheets are not lifted. The paper tray 10 includes a bottom plate 12 in contact with the first sheet S1 and a stopper 14 for stopping leading edges L1 and L2 of the first sheet S1 and the second sheet S2.

The pick-up roller 20, which may be moved in a direction indicated by the arrow by the rocker arm 50 connected to a separating roller 42 and the pick-up roller 20, can rotate and pick up the second sheet S2 and enables the leading edge L2 of the second sheet S2 to pass over the stopper 14.

The sheet-lifting mechanism 30, which may be fixed to or disposed on the bottom plate 12 and/or the stopper 14 of the paper tray 10, can apply an upward lifting force to the first sheet S1 and the second sheet S2, lifting the leading edge L2 of the second sheet S2 and the leading edge L1 of the first sheet S1 from the bottom plate 12. When the leading edge L1 of the first sheet S1 is lifted from the bottom plate 12, only a portion of the first sheet S1 is in contact with the bottom plate 12. That is, if the sheet-lifting mechanism 30 is removed, the leading edge L1 lies on the bottom plate 12 and the entirety of the first sheet S1 is in contact with the bottom plate 12. The bottom plate 12 of FIG. 1 is connected with the stopper 14.

When only the first sheet S1 is left in the paper tray 10, the bottom plate 12 of the paper tray 10 is in partial surface contact with the first sheet S1. The sheet-lifting mechanism 30 lifts the leading edge L1 of the first sheet S1 from the bottom plate 12 and the stopper 14 stops the leading edge L1 of the sheet S1. The pick-up roller 20, which is movable and rototable, picks up the first sheet S1 and enables the leading edge L1 of the first sheet S1 to pass over the stopper 14.

The sheet separating mechanism 40, which includes the separating roller 42 and a sheet separating pad 44 in contact with the separating roller 42, receives and feeds the second sheet S2, which passes over the stopper 14, and feeds the second sheet S2 and blocks the first sheet S1 in case that both of the first sheet S1 and the second sheet S2 pass over the stopper 14.

The sheet-lifting mechanism 30 may have various variations. For example, the sheet-lifting mechanism 30 may only include one upper elastic piece 33 or a lower elastic piece 31. Alternatively, the sheet-lifting mechanism 30 may include an upper elastic piece 33 and a lower elastic piece 31, or include one lower elastic piece 31 and two upper elastic pieces 33 respectively disposed on two sides of the lower elastic piece 31. Thus, the number of the upper elastic pieces 33 and the lower elastic pieces 31 can be adjusted according to the design requirements such that various combinations may be carried out.

Figure 4:
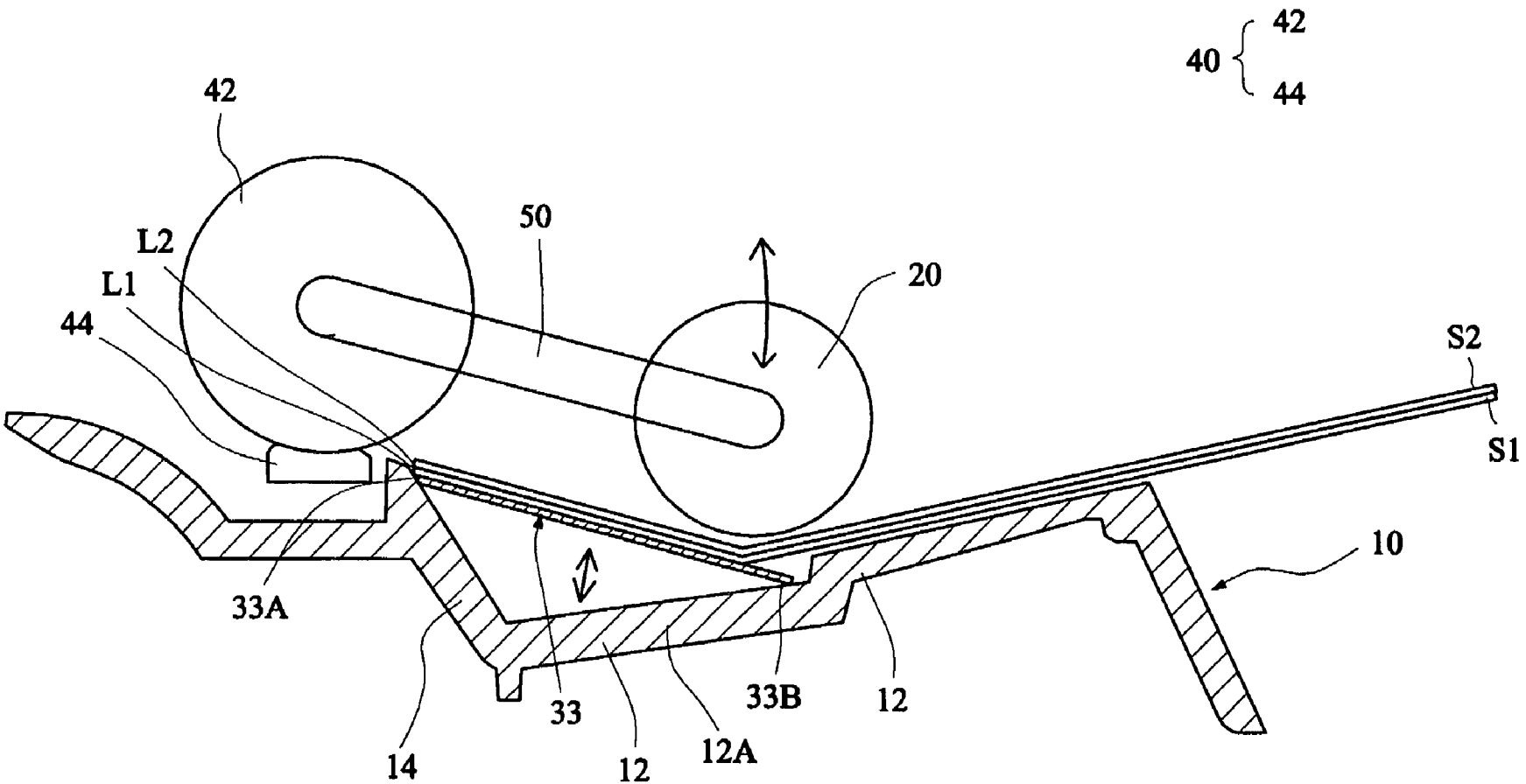
FIG. 4 is a schematic illustration showing a second modified example of FIG. 1.

As shown in FIGS. 2 and 4, each of the upper elastic pieces 33 for lifting the first sheet S1 and the second sheet S2 has a first end 33A disposed on the stopper 14 and a second end 33B in sliding contact with or movably lying on the bottom plate 12.

Figure 3:
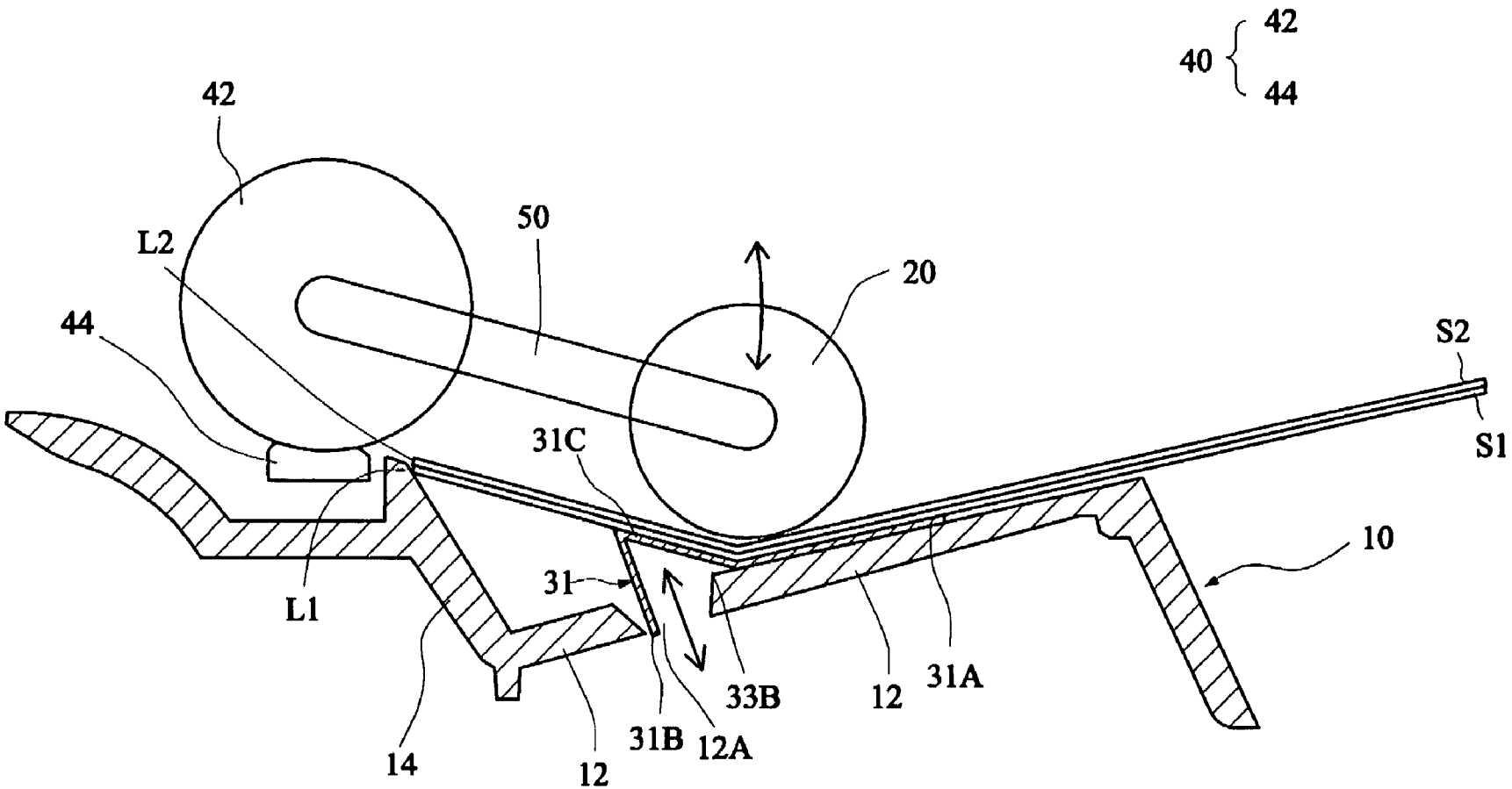
FIG. 3 is a schematic illustration showing a first modified example of FIG. 1.

As shown in FIGS. 2 and 3, the lower elastic piece 31 for lifting the first sheet S1 and the second sheet S2 has a first end 31A disposed on the bottom plate 12 and a free second end 31B. Two contact points P2 of the upper elastic pieces 33 and the first sheet S1 are located on two sides of one contact point P1 of the lower elastic piece 31 and the first sheet S1, such that the leading edges L1 and L2 of the first sheet S1 and the second sheet S2 may be kept leveled, and the situation that the middle of the sheet can pass over the stopper but the two sides of the sheet cannot pass over the stopper can be avoided. When only the first sheet S1 is left in the paper tray 10, the two contact points of the upper elastic pieces 33 and the first sheet S1 are located on two sides of the contact point of the lower elastic piece 31 and the first sheet S1. As shown in FIG. 3, the lower elastic piece 31 further has a middle portion 31C for connecting the first end 31A to the second end 31B. The middle portion 31C is bendable towards the first end 31A and supports the sheet The second end 31B is bendable towards the middle portion 31C and movable within a first recess 12A of the bottom plate 12. The middle portion 31C contacts the sheet S1 to lift the sheets S1 and S2. When only the first sheet S1 is left in the tray 10, the middle portion 31C pushes the sheet S1 upwards. Alternately, the lower elastic piece 31 may have no middle portion 31C. In this case, the lower elastic piece 31 may have the first end 31A disposed on the bottom plate 12 and the second end 31B in sliding contact with the stopper 14 so as to lift the sheets.

Figure 5:
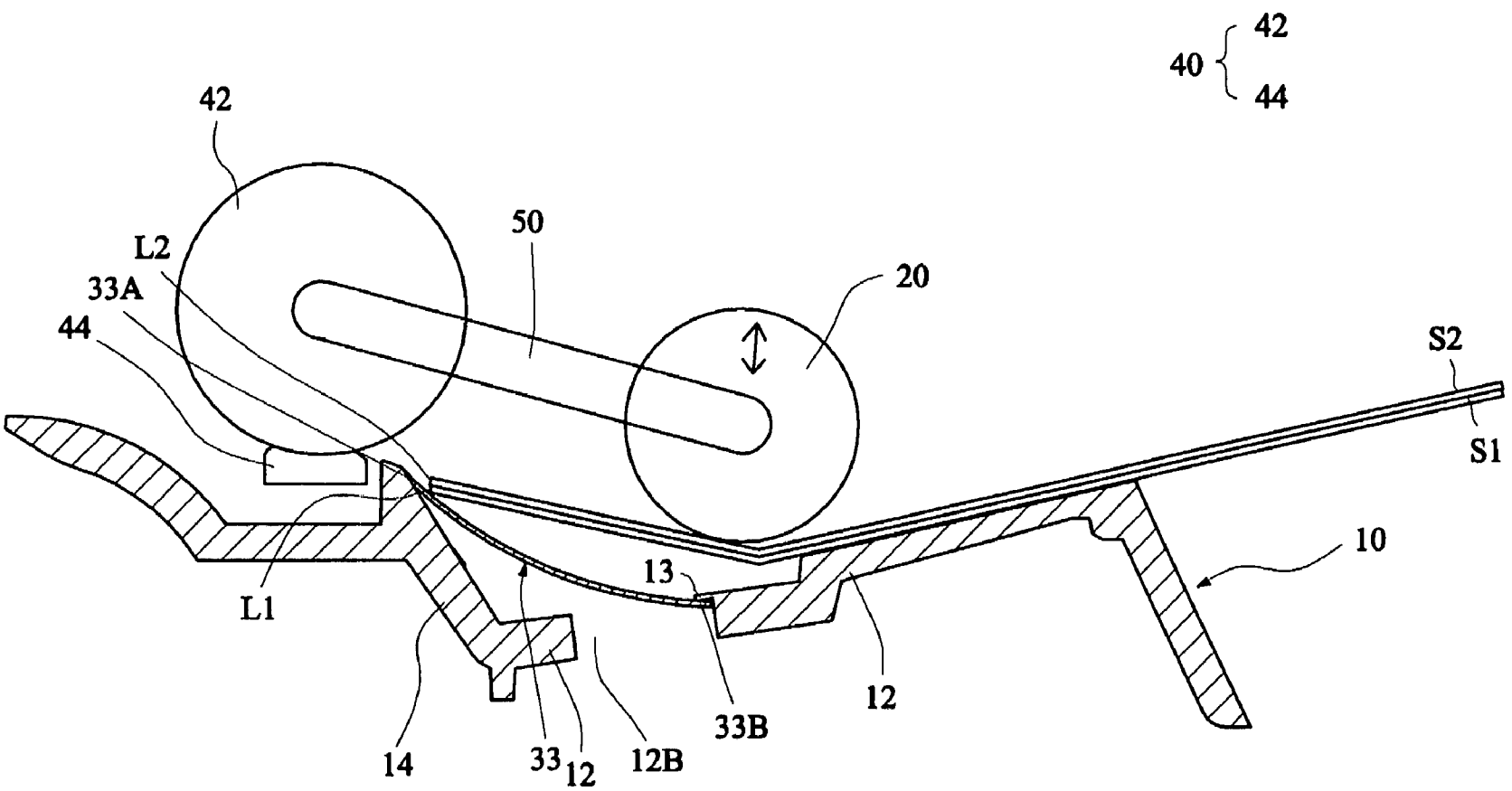
FIG. 5 is a schematic illustration showing a third modified example of FIG. 1.

As shown in FIGS. 2 and 5, the upper elastic piece 33 has the first end 33A disposed on the stopper 14 and the second end 33B movably accommodated within a second recess 12B of the bottom plate 12. Thus, it is possible to prevent the second end 33B of the upper elastic piece 33 from warping and thus blocking the sheets inserted into the paper tray. The second recess 12B may also have a flange 13 for restricting the upper elastic piece 33 within the second recess 12B.

Figure 6:
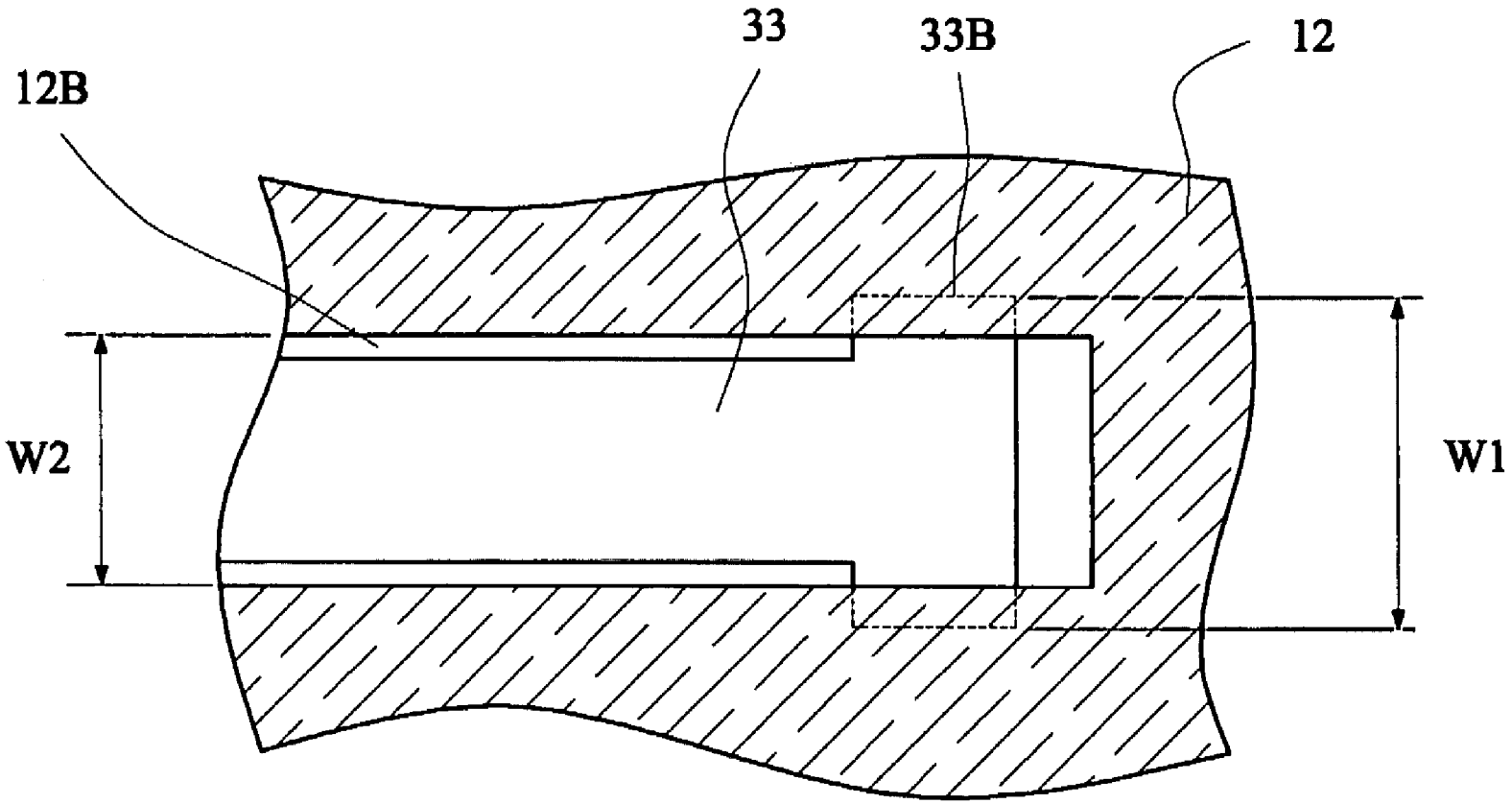
FIG. 6 is a partial top view of FIG. 5.

As shown in FIGS. 6 and 5, no matter whether the flange 13 exists or not, a width W1 of the second end 33B of the upper elastic piece 33 is greater than a width W2 of the second recess 12B in order to prevent the second end 33B of the upper elastic piece 33 from leaving the second recess 12B. During installation, the second end 33B of the upper elastic piece 33 may be inserted into the second recess 12B by slightly twisting the upper elastic piece 33.

Figure 7:
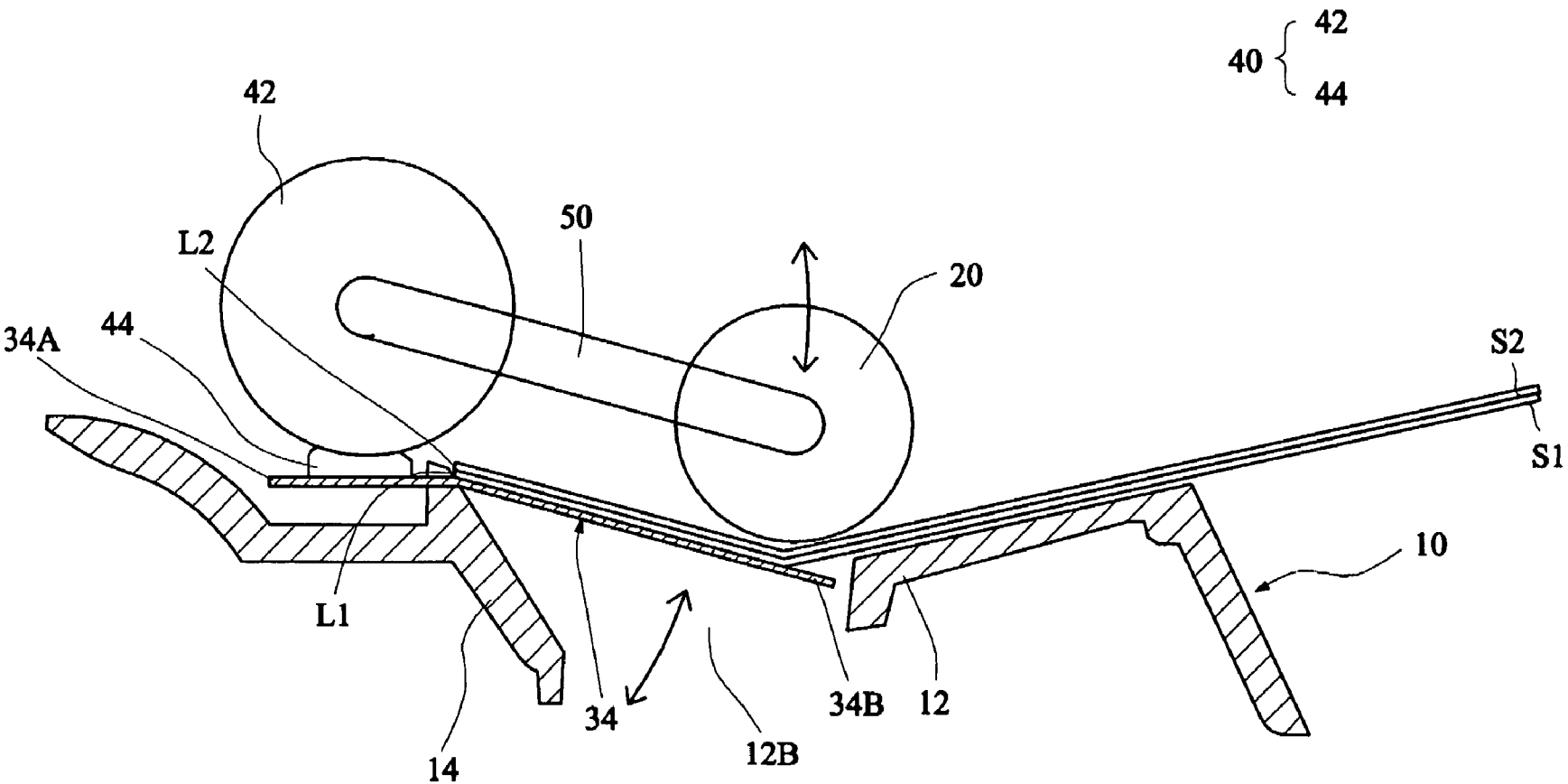
FIG. 7 is a schematic illustration showing a fourth modified example of FIG. 1.

As shown in FIG. 7, the sheet-lifting mechanism 30 is an elastic piece 34 disposed on the stopper 14. The elastic piece 34 has a free first end 34A and a free second end 34B. The sheet separating pad 44 is disposed on the elastic piece 34 and near the first end 34A but far from the second end 34B.

Figure 8:
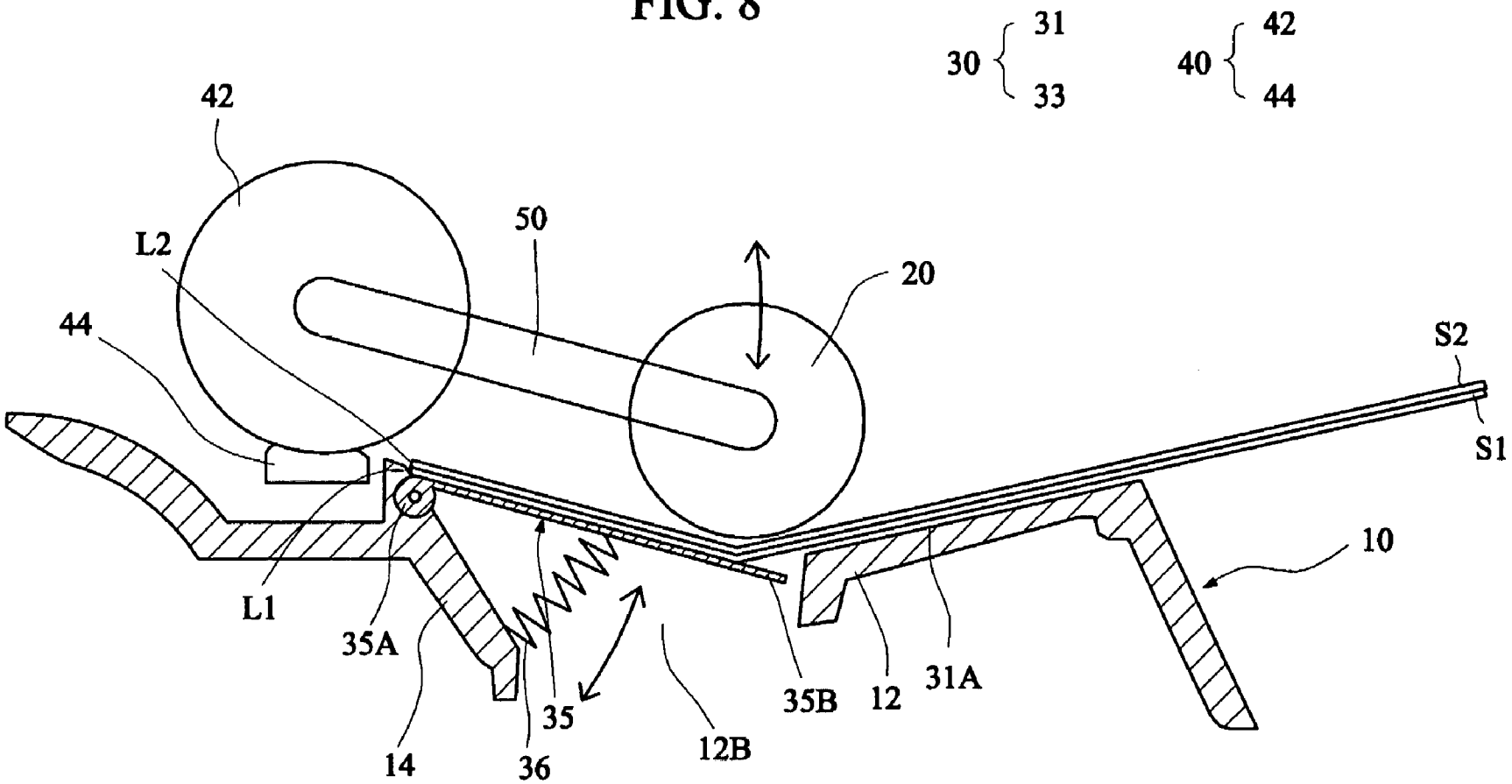
FIG. 8 is a schematic illustration showing a fifth modified example of FIG. 1.

Referring to FIG. 8, the sheet-lifting mechanism 30 includes a flat plate 35 and a spring 36. One end of the flat plate 35 is pivoted on the stopper 14. The spring 36 disposed between the flat plate 35 and the stopper 14 applies a resilient force to the flat plate 35 when the flat plate 35 is pressed down by the first sheet S1 and the second sheet S2. When only the first sheet S1 is left in the paper tray 10, the spring 36 applies a resilient force to the flat plate 35 pressed down by the sheet S1. Thus, the leading edges of the sheets may be lifted under the cooperation of the spring 36 and the pivotal flat plate 35.

In summary, the effect provided by this invention can block a stack of sheets using the stopper and then lift the sheets using the sheet-lifting mechanism. According to the structure of the invention, the leading edge of the sheet can be effectively lifted to facilitate the operation of picking up the sheet.

According to the action of the elasticity of the elastic piece or the spring, the elastic piece or the flat plate is pressed down by a larger distance when more sheets are placed in the paper tray. Thus, the topmost sheet is positioned near the top of the stopper. When the sheets are fewer, the elastic piece or the flat plate is pressed down by a smaller distance. Thus, the topmost sheet is still positioned near the top of the stopper. Consequently, the user does not have to stack the sheets to a minimum level to solve the problem of the unsmooth sheet feeding operation. In addition, the sheets do not slide backward and out of the paper tray to cause the unsmooth sheet-feeding operation because the sheets are only partially lifted.

While the invention has been described by way of examples and in terms of a preferred embodiment it is to be understood that the invention is not limited thereto. To the contrary, it is intended to cover various modifications. Therefore, the scope of the appended claims should be accorded the broadest interpretation so as to encompass all such modifications.

What is claimed is:

1. An automatic document feeder, comprising:

a paper tray, which comprises a bottom plate on which a sheet is placed, and a stopper for stopping a leading edge of the sheet;

a pick-up roller, which is movable and rotatable, for picking up the sheet to enable the leading edge of the sheet to pass over the stopper; and a sheet-lifting mechanism, which is elastic and is disposed in the paper tray, for applying an upward lifting force to the sheet placed on the bottom plate, wherein the sheet-lifting mechanism comprises:

a first elastic piece having a first end disposed on the bottom plate, a free second end, and a middle portion connecting the first end to the second end, wherein the middle portion is bendable towards the first end, and the second end is bendable towards the middle portion and movable within a recess of the bottom plate; and a second elastic piece having a first end disposed on the stopper and a second end in sliding contact with the bottom plate.

2. An automatic document feeder, comprising:

a paper tray, which comprises a bottom plate on which a sheet is placed, and a stopper for stopping a leading edge of the sheet;

a pick-up roller, which is movable and rotatable, for picking up the sheet to enable the leading edge of the sheet to pass over the stopper; and a sheet-lifting mechanism, which is elastic and is disposed in the paper tray, for applying an upward lifting force to the sheet placed on the bottom plate, wherein the sheet-lifting mechanism comprises:

two first elastic pieces, each of which has a first end disposed on the stopper and a second end in sliding contact with the bottom plate;

a second elastic piece having a first end disposed on the bottom plate and a free second end, wherein the two first elastic pieces are disposed on two sides of the second elastic piece.

3. An automatic document feeder, comprising:

a paper tray, which comprises a bottom plate on which a sheet is placed, and a stopper for stopping a leading edge of the sheet;

a pick-up roller, which is movable and rotatable, for picking up the sheet to enable the leading edge of the sheet to pass over the stopper; and a sheet-lifting mechanism, which is elastic and is disposed in the paper tray, for applying an upward lifting force to the sheet placed on the bottom plate, wherein the sheet-lifting mechanism comprises:

two first elastic pieces, each of which has a first end disposed on the stopper and a second end in sliding contact with the bottom plate;

a second elastic piece having a first end disposed on the bottom plate, a free second end, and a middle portion connecting the first end of the second elastic piece to the second end of the second elastic piece, wherein the middle portion is bendable towards the first end of the second elastic piece, the second end of the second elastic piece is bendable towards the middle portion and movable within a recess of the bottom plate, and the two first elastic pieces are disposed on two sides of the second elastic piece.

* * * * *